US006694848B1

(12) United States Patent
Flavigny

(10) Patent No.: US 6,694,848 B1
(45) Date of Patent: Feb. 24, 2004

(54) FAST APPROACH SELF-ADJUSTING PLIERS FOR SINGLE-HANDED MANIPULATION

(75) Inventor: Jean-Pierre Flavigny, Saint Pe sur Nivelle (FR)

(73) Assignee: Facom, Morangis (FR)

( * ) Notice: Subject to any disclaimer, the term of this patent is extended or adjusted under 35 U.S.C. 154(b) by 0 days.

(21) Appl. No.: 10/088,393

(22) PCT Filed: Sep. 15, 2000

(86) PCT No.: PCT/FR00/02575

§ 371 (c)(1),
(2), (4) Date: Mar. 19, 2002

(87) PCT Pub. No.: WO01/23143

PCT Pub. Date: Apr. 5, 2001

(30) Foreign Application Priority Data

Sep. 27, 1999 (FR) ..... 99 12008

(51) Int. Cl.[7] ..... B25B 7/04
(52) U.S. Cl. ..... 81/413; 81/409.5; 81/357
(58) Field of Search ..... 81/405–409, 409.5, 81/413, 414, 329, 330, 337, 321, 393–394, 385, 355–360

(56) References Cited

U.S. PATENT DOCUMENTS

| | | | | | |
|---|---|---|---|---|---|
| 1,386,149 | A | | 8/1921 | Allan | |
| 1,651,216 | A | | 11/1927 | McGill | |
| 2,906,155 | A | | 9/1959 | Miller | |
| 4,893,530 | A | * | 1/1990 | Warheit | 81/409.5 |
| 5,060,543 | A | * | 10/1991 | Warheit | 81/409 |
| 5,351,584 | A | * | 10/1994 | Warheit | 81/407 |
| 6,212,978 | B1 | * | 4/2001 | Seber et al. | 81/357 |

FOREIGN PATENT DOCUMENTS

| | | |
|---|---|---|
| DE | 298 06 998 | 7/1998 |
| EP | 0 218 760 | 4/1987 |
| FR | 2 052 020 | 4/1971 |

* cited by examiner

*Primary Examiner*—D. S. Meislin
(74) *Attorney, Agent, or Firm*—Wenderoth, Lind & Ponack L.L.P.

(57) ABSTRACT

An adjustable pair of pliers including two branches, and each branch has an articulation region located between a jaw portion and a handle portion. A first branch includes a guide surface 25, and an articulation surface 26, a front guide mechanism 11, and a front articulation mechanism 12. A rear guide mechanism 17, 43 is provided for guiding the second branch.

21 Claims, 6 Drawing Sheets

FAST APPROACH SELF-ADJUSTING PLIERS FOR SINGLE-HANDED MANIPULATION

BACKGROUND OF THE INVENTION

The present invention relates to a pair of quick-close adjustable pliers operable capable of being operated with one hand.

The current state of the art in the field of quick-close adjustable or "multigrip" pliers comprises two categories of tool.

The first category includes pliers that can be operated with only one hand, in which the articulation means (or "finger") is normally disengaged from the articulation surface, which is generally toothed. An example of this type of tool is described in EP-A-0 218 760. One disadvantage with these pliers lies in the absence of memory of the articulation point, which can be obtained only by clamping an object. As soon as clamping is released the pliers return to the wide open position, And this forces the operator to overcome the force of the jaw-opening spring each time the pliers are used. Repeated use of such a tool is therefore very tiring.

The second category includes pliers of the aforementioned type, in which the finger is normally in engagement (see, for example, U.S. Pat. No. Des. 297 802). These pliers remember the articulation point, but need both hands for the closing phase. The "closing phase" is to be understood as meaning the step during which the two jaws are not in contact with an object that is to be gripped, and forces are exerted on the handles in suitable directions that tend to close the jaws.

SUMMARY OF THE INVENTION

The object of the invention is to provide a pair of quick-close adjustable pliers which combines the advantages of both of the above types of pliers. Specifically, the object is to provide a pair of pliers which, can be operated with one hand, and which also remembers the articulation point after adjustment.

BRIEF DESCRIPTION OF THE DRAWING

Exemplary embodiments of the invention will now be described with reference to the appended drawings, in which.

DETAILED DESCRIPTION OF THE INVENTION

Figure 1:
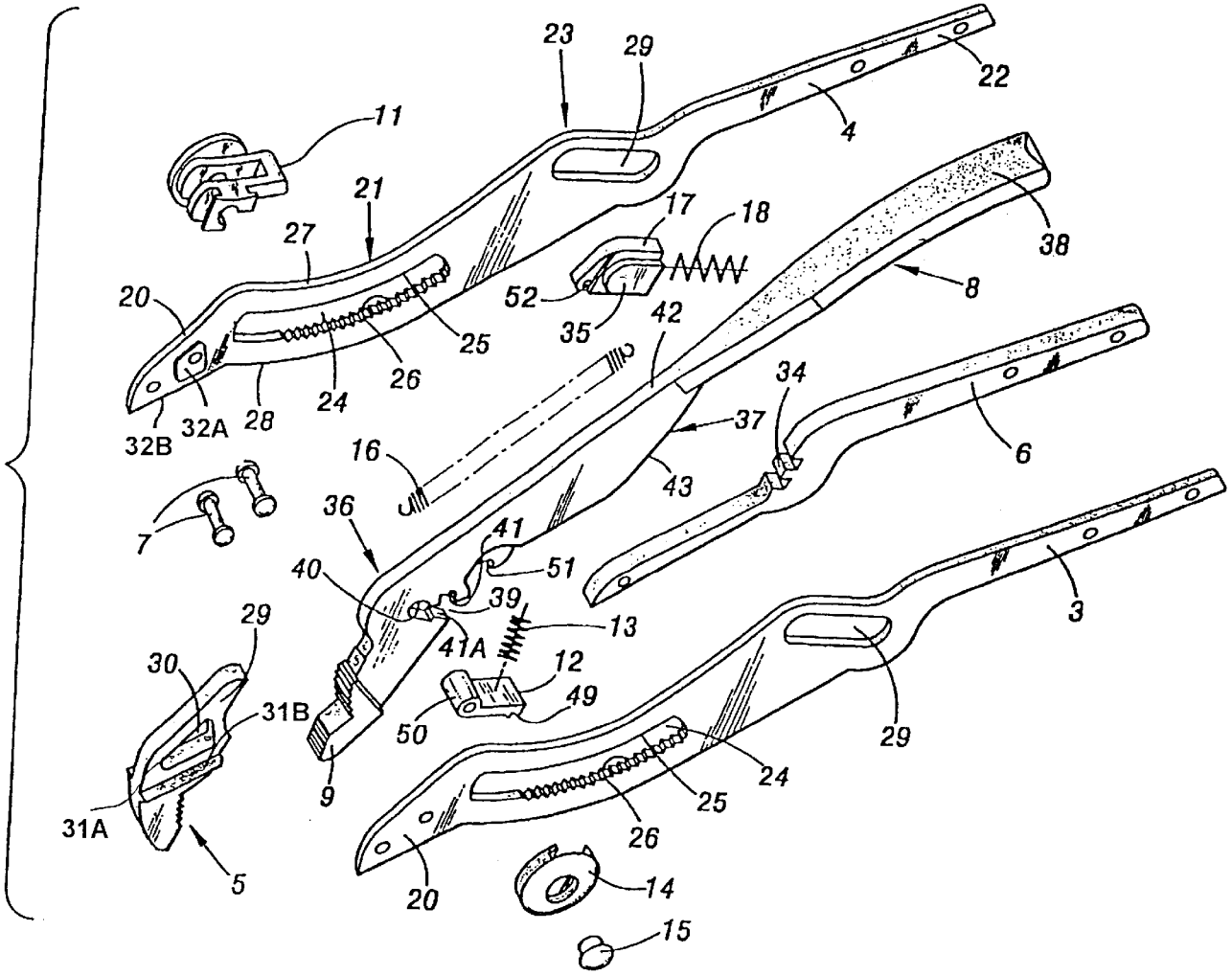
FIG. 1 is an exploded perspective view of pliers according to the present invention.
Figure 5:
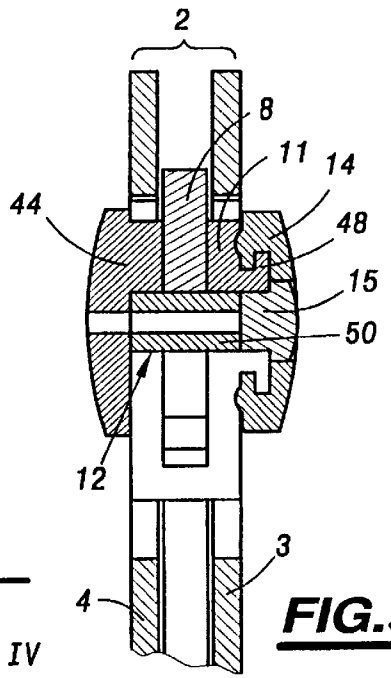
FIGS. 4 and 5 are sectional views taken, respectively, along lines IV—IV and V—V of FIG. 3.
Figure 4:
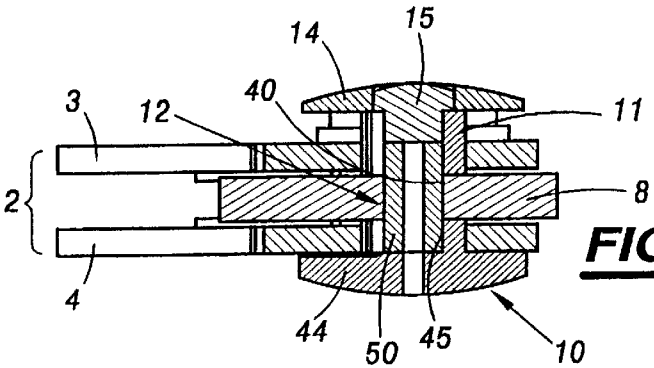
Figure 3:
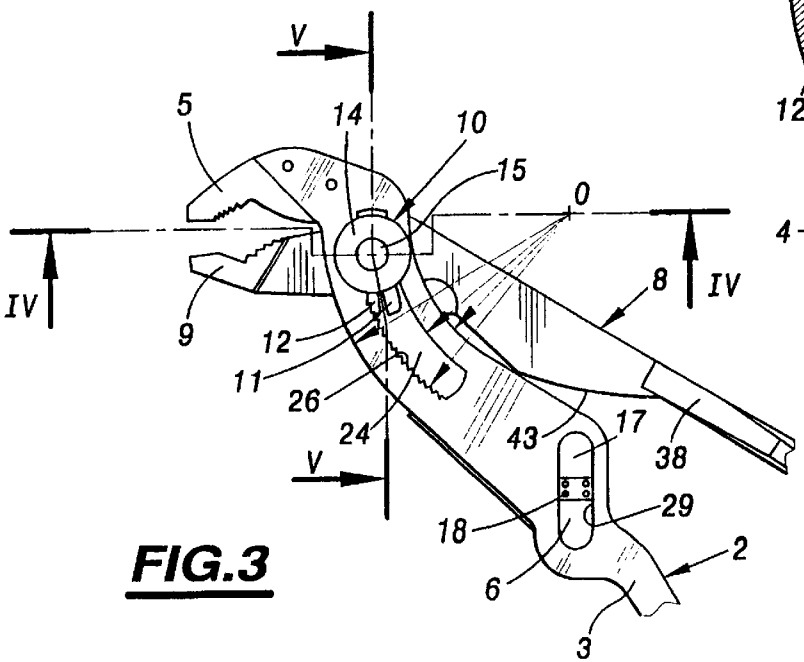
FIG. 3 is a side view of the pliers.

The pliers 1 depicted in FIGS. 1 to 5 include the following components. A slip-through fixed branch 2, is formed of two cheeks 3 and 4 made of cut steel sheet, a fixed or upper jaw 5, a rear spacer 6 having an elongated shape, and assembly rivets 7 (two of these rivets shown). A slipped-through one-piece moving branch 8 includes, at the front, an integrally formed moving jaw 9. An articulation device 10 includes a carriage 11, a finger 12, a spring 13 for urging the finger, and two fixing members 14 and 15. A helical spring 18 is provided for opening the two jaws and a rear slider 17 is urged by a helical spring 18.

Each of the cheeks 3 and 4 comprises a jaw-bolder front part 20, an intermediate articulation region 21, a rear grip region 22 and, between the rear grip region 22 and the intermediate articulation region 21, a rear bearing region 23 for the branch 8. The two rear grip regions 22 form the fixed or lower handle of the pliers.

The articulation region 21 is arched and includes a slot 24, itself arched. The upper surface 25 of the slot 24 is plain (i.e., substantially smooth) and the lower surface 26 of the slot 24 is toothed and forms a curved rack. The upper surface 27 and the lower surface 28 of the articulation region 21, and the surfaces 25 and 26 define four concentric circular arcs, the center O (FIG. 3) of which is virtual and lies distinctly outside and above the contour of the tool.

The rear bearing region 23 is pierced with a straight (elongated) slot 29 which roughly extends toward the point O.

The upper jaw 5 comprises a rear yield 30 which is positioned, by virtue of a slot 31A and of a shoulder 31B, on interior reliefs 32A and on a lower surface 32B of the front parts 20 of the cheeks 3 and 4, as described in FR-A-2 753 644.

The spacer 6 is positioned, by virtue of appropriate reliefs (not depicted) between the lower part of the two bearing regions 23 and between the two rear grip regions 22. The spacer piece 6 has an upper recess 34 in its intermediate region for the lower end of the spring 18 to bear on. Furthermore, the slider 17 has, on each side, a relief 35 having an elongated shape designed to be guided in the adjacent slot 29.

The slipped-through branch 8 also includes, starting from its jaw 9, an intermediate articulation region 36, a rear bearing region 37 and a rear grip region 38 forming a handle. A notch 39 formed in the articulation region 36 starts from the lower edge of the branch and ends in a recess 40 roughly the shape of three quarters of a circle. An indentation 41 is provided in the rear face of the notch 39, while the front face of this notch has a boss 41A at the entrance to the notch.

The rear bearing region 37 has a roughly straight upper surface 42, and has a rear portion with an arched active lower surface 43 roughly in the shape of a circular arc. The center of curvature of lower surface 43 is virtual and lies distinctly outside and above the contour of the tool. This center may be coincident with the aforementioned point O, or close to the latter in the various positions of the branch 8 during the closure phase described later on.

Figure 2:
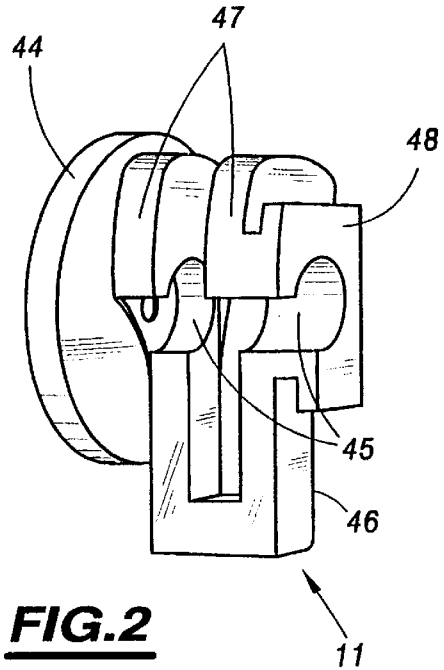
FIG. 2 is an enlarged perspective view of a component of these pliers.

As can be seen better in FIG. 2, the carriage 11 is a one-piece part having the overall shape of a U, to which a bearing washer 44 is attached. Each flange of the U has a recess 45 roughly in the shape of three quarters of a circle, these recesses being coaxial and having the same radius as the recess 40 of the branch 8. The upper surface 46 (which extends over the entire length of the carriage) and lower surface 47 (which extends only forward of the recesses 45) of the U are arched with radii equal to those of each of the surfaces 25 and 26, of the slots 24. A washer 44 is provided on one flange of the U, while the other flange has an external relief 48 in the shape of a dovetail through which the adjacent recess 45 passes.

The finger 12 has the shape of a plate arranged perpendicular to the branches 2 and 8, and the lower surface of the finger 12 has teeth 49 at its rear end. 1The front end of the finger forms a cylindrical bulge (axle) 50 designed to be accommodated so as to pivot in the three recesses 40 and 45 which together form a bearing.

The pliers are assembled as follows. The carriage 11 is introduced sideways through the slot 24 in the cheek 4 until the washer 44 butts against the exterior face of the cheek 4. The branch 8 is slipped into the "U" of the carriage 11. The axes of the three recesses 40 and 45 are brought into coincidence, and the finger 12 is positioned so that its bulge (axle) 50 is fitted in these recesses with the spring 13 pressed between the main part of the finger 12 and the bottom of the indentation 41. The jaw 5, spacer 6 and slider 17 are stacked together with the spring 18 compressed between the slider 17 and the recess 34 of the spacer 6.

The spring 16 is stretched between a lower relief 51 on the branch 8 behind the notch 39, and an orifice 52 of the slider 17. The cheek 3 is positioned on the thus-assembled structure and the cheek 3, cheek 4, jaw 5 and spacer 6 are joined together using the rivets 7.

Assembly of the articulation device 10 is completed by fitting the component 14 (which is a washer similar to the washer 44) onto the external relief 48 of the carriage 11. Then, the fixing member 15 (which is a button with a head) is press-fitted into the central hole of the washer 14.

Figure 6:
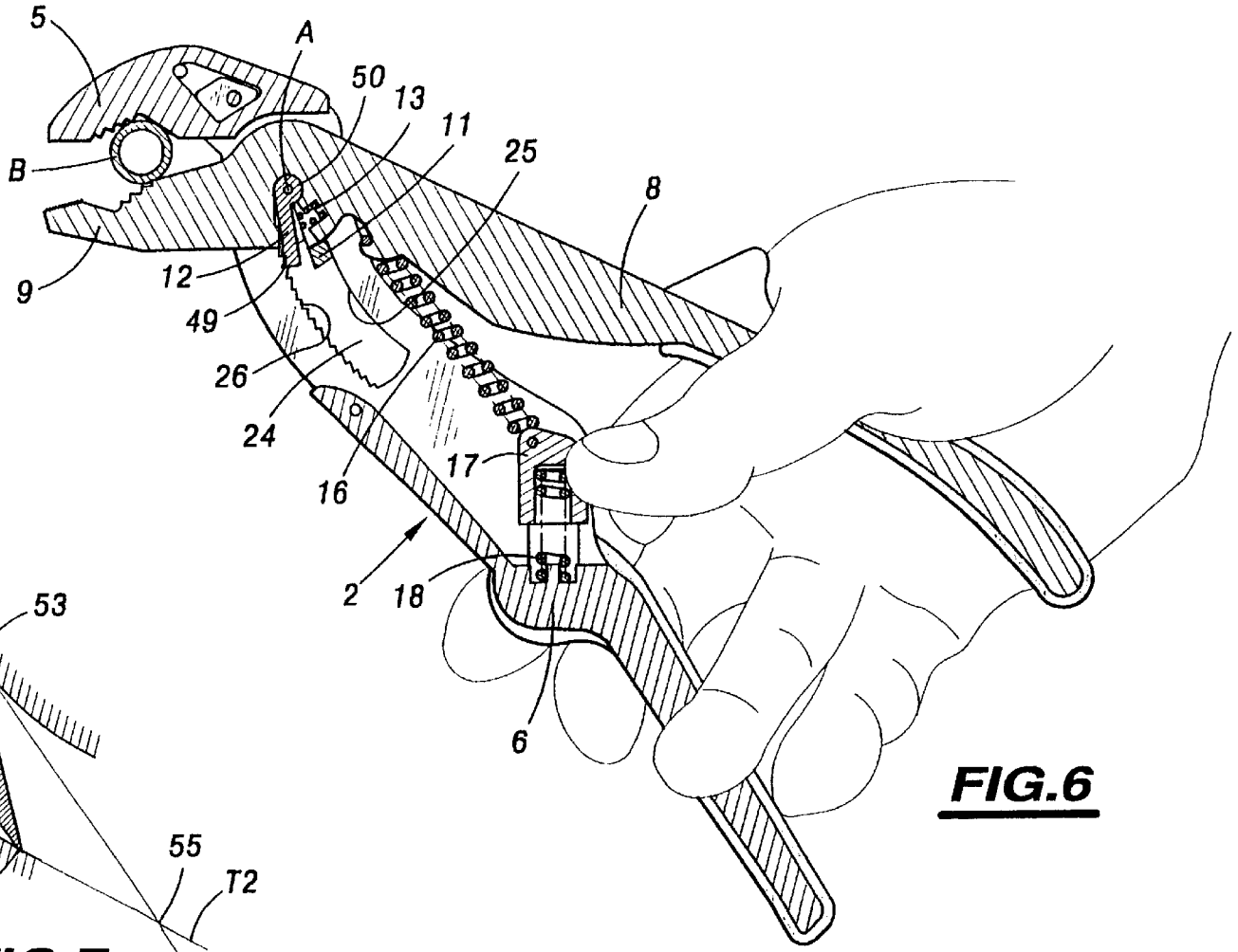
FIG. 6 is a longitudinal section view illustrating the repeated use of the pliers.

In the assembled state, each flange of the U of the carriage is therefore guided in a slot 24. As can be seen in FIG. 6, the longitudinal movement of the moving branch 8 is guided simply by the collaboration of the flanges of the carriage 11 and the slots 24. The finger 12, which has limited freedom of movement about the axis A of the recesses 40 and 45, is urged by the spring 13 so that it is normally in engagement, via its set of teeth 49, with the racks 26.

For a particular position of the finger 12 along the slots 24, the axis A defines a fixed axis of articulation of the branch 8 with respect to the branch 2 (i.e., cheeks 3 and 4). Because of the constant urging apart of the two jaws by the spring 16, the position of the axis A is firmly maintained, and the tool can be used like conventional pliers, until the two branches are opened to a predetermined angular extent. Repeated operations of gripping/releasing an object B can therefore be performed without tiring.

Note that the clamping effect, at the articulation region, is exerted only by longitudinal compression of the finger 12 between the racks 26 of the branch 2, at one end, and the bottom of the recess 40 of the branch 8 at the other end, without any force being exerted on the carriage 11. The carriage can therefore be made of a lightweight material, for example plastic.

When the opening of the two branches brings the boss 41A of the front edge of the notches 39 into contact with the finger 12, additional opening of these branches positively causes the set of teeth 49 to be disengaged from racks 26 thereby, compressing the spring 13. Therefore, under the effect of the opening spring 16, the carriage 11 retreats.

Figure 7:
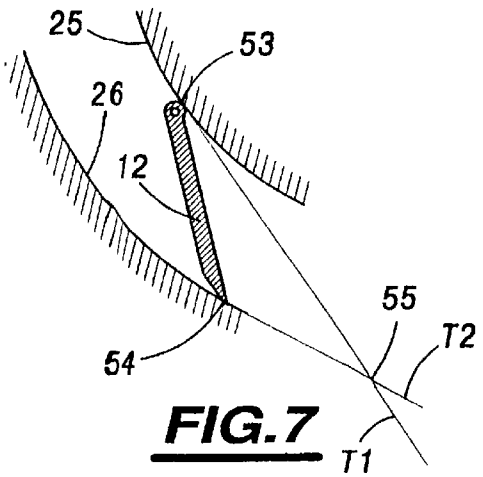
FIG. 7 is a schematic enlarged detailed view of a portion of the pliers.

However, as illustrated schematically on a larger scale in FIG. 7, by virtue of the arched shape of the slots 24 and because of the length and arrangement of the finger 12, there is a longitudinal offset between the front 53 (indirect bearing via the carriage 11) and rear 54 (direct bearing) bearing points of the finger 12 on the surfaces 25 and 26 of slot 24. The tangents T1 and T2 to the surfaces 25 and 26 at the bearing points 53 and 54 cross at a point 55 situated at the rear of the finger 12. As a result, when the rear bearing point disengages from the rack surfaces 26, the finger, guided by the carriage only along the tangent T1, tends to move closer to the rack surfaces 26, and therefore to come into engagement with the rack surfaces 26 via its rear set of teeth 49.

In addition, because of the curvature of the slots 24, the two branches need be opened increasingly wide in order to disengage the finger when the finger moves toward the rear of the slots. Consequently, the finger, having been disengaged from a tooth of rack surface 26, immediately comes back into engagement with the next tooth of rack 26, or with a tooth of rack 26 situated slightly further back, under the effect of the spring 13.

It will thus be understood that the increase in the separation of the two jaws 5 and 6 is controlled, practically tooth by tooth and one-handedly, by preferably placing the ring finger against the upper face of the handle of the branch 2 as illustrated in FIG. 6.

Figure 8:
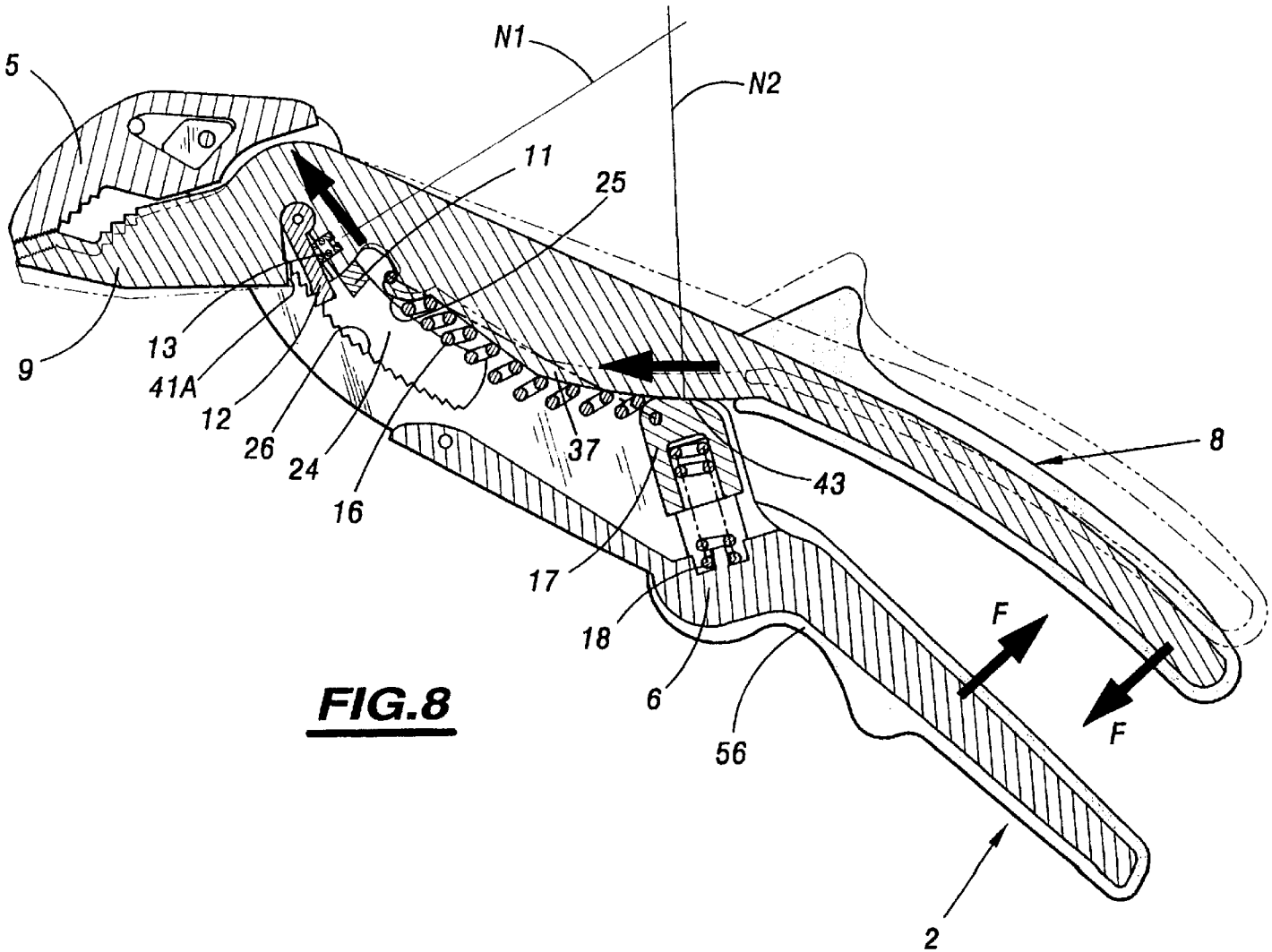
FIG. 8 is a view similar to FIG. 6 illustrating the operation of the pliers.

To reduce the separation of the two jaws, as illustrated in FIG. 8, the two handles are brought together. Before the rear face of the notch 39 comes into contact with the finger 12, the active surface 43 of the branch 8 comes into contact with the slider 17. The slider is kept in a raised position, with its reliefs 35 in abutment at the upper end of the slots 29, by the spring 18, which has a relatively high stiffness. The geometry of the components is such that continuing to apply the closing force on the handles causes the surface 43 to slide along the slider and, at the same time, causes the carriage 11 to slide forward in the slots 24.

Thus, the carriage 11 and the slider 17 together form a cradle which guides the branch 8 forward in a roughly circular movement about center O. During this movement, the moving branch is guided, laterally by the collaboration of its bearing region 37 and the cheeks 3 and 4. During this movement, the finger ratchets and engages the sets of teeth 26 as soon as the movement stops. During this closing phase, at each moment, the normal N2 to the point of contact between the front guide surface 25 and the bearing surface 43 forms a V-shaped angle slightly smaller than or equal to 90° with any other normal N2 or with the normal N1 to the point of contact between the spring 13 and recess 39 (see FIG. 8). The point of which V faces toward the opposite side of the branches to the jaws, that is say upward.

In order to incline the forces F exerted on the handles to make this closing movement easier, the external surface of the upper handle is externally convex, and the lower handle includes a recess 56 at the front to house the index or middle finger (FIG. 8). As an alternative (shown in FIGS. 10 and 11), the external surface of the lower handle may be concave.

Figure 9:
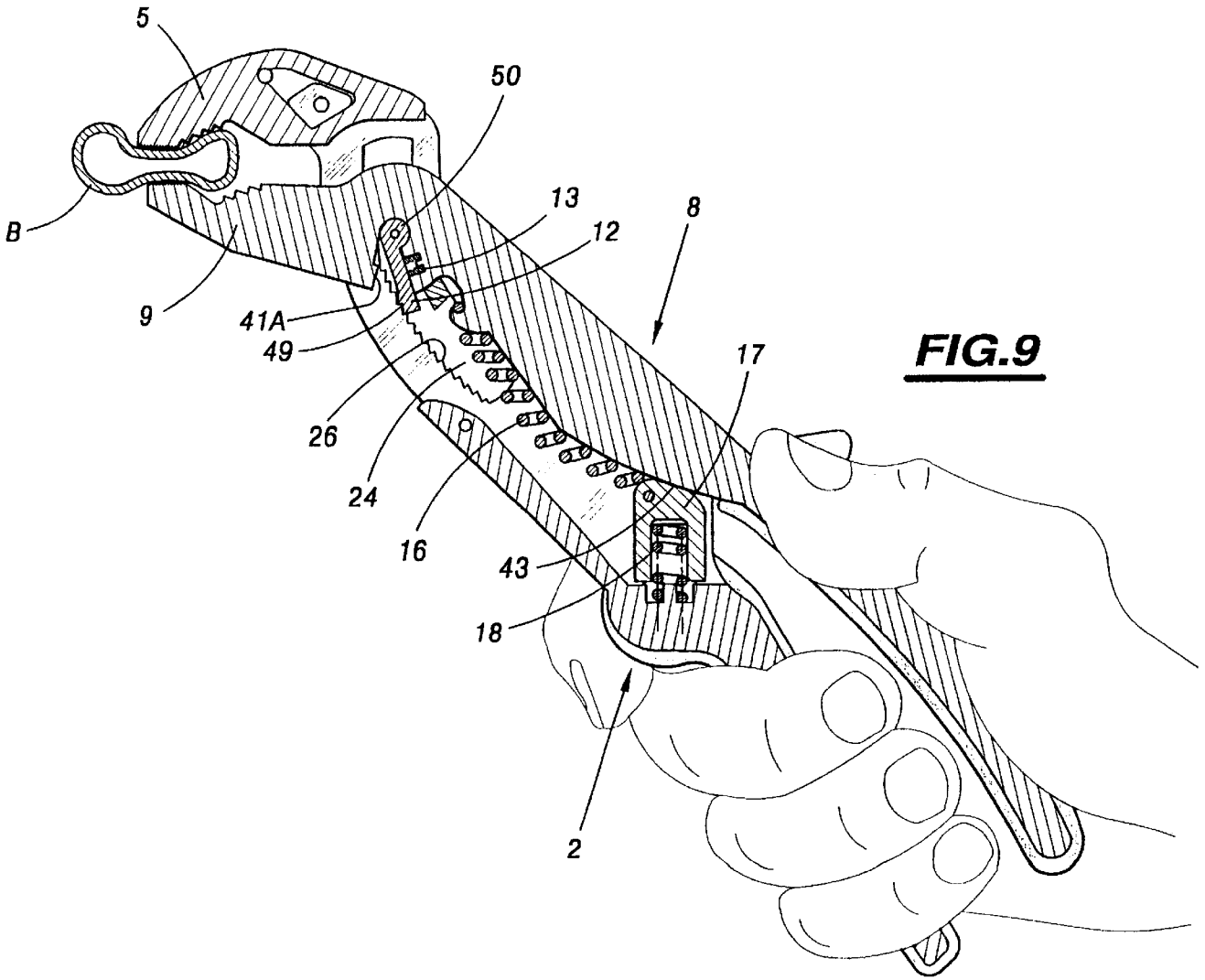
FIG. 9 is a view similar to FIG. 6 illustrating another use of the pliers.

As depicted in FIG. 8, during the closing phase of use of the pliers, which is the phase closing in on an object that is to be gripped, the bearing region 37, bulging on the bottom, causes the spring 16 to flex, at least in a certain range of jaw opening. Consequently, when the closing phase is over, as illustrated by the chain line in FIG. 8, the spring 16 straightens and confers on the branch 8 a slightly open position of rest corresponding, for example, to the gripping of a nut. This makes repeated use of the pliers particularly pleasant, The squashing of the spring 18 also makes it possible to exert additional clamping on the object B, as illustrated in FIG. 9. It also makes it possible to ensure that the teeth 26 and 49 mesh properly even if, at the end of the closure phase (i.e., when the two jaws come into contact with the object B) the teeth are not exactly facing each other.

Figure 10:
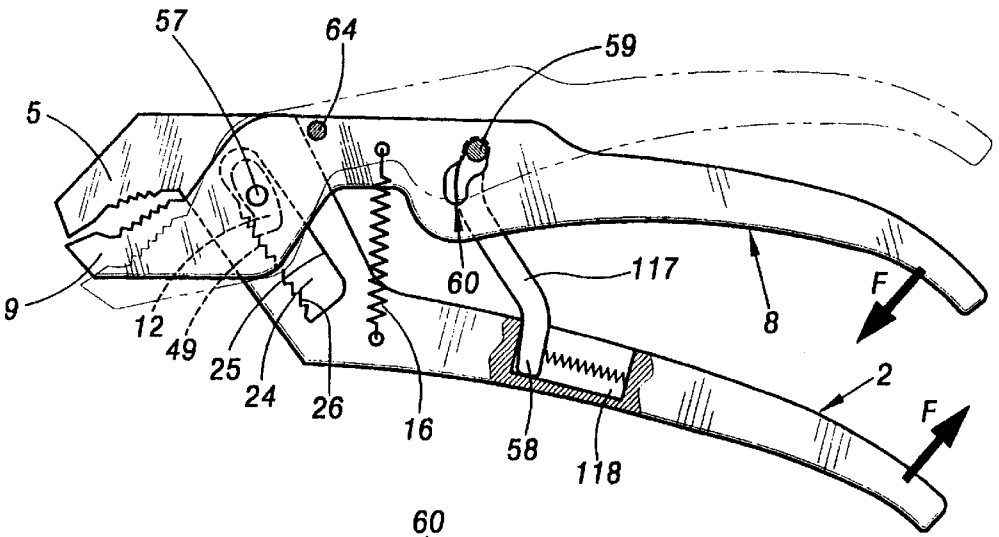
FIG. 10 is a schematic side view of another method of embodiment of the pliers according to the invention, in the repeated use position.
Figure 11:
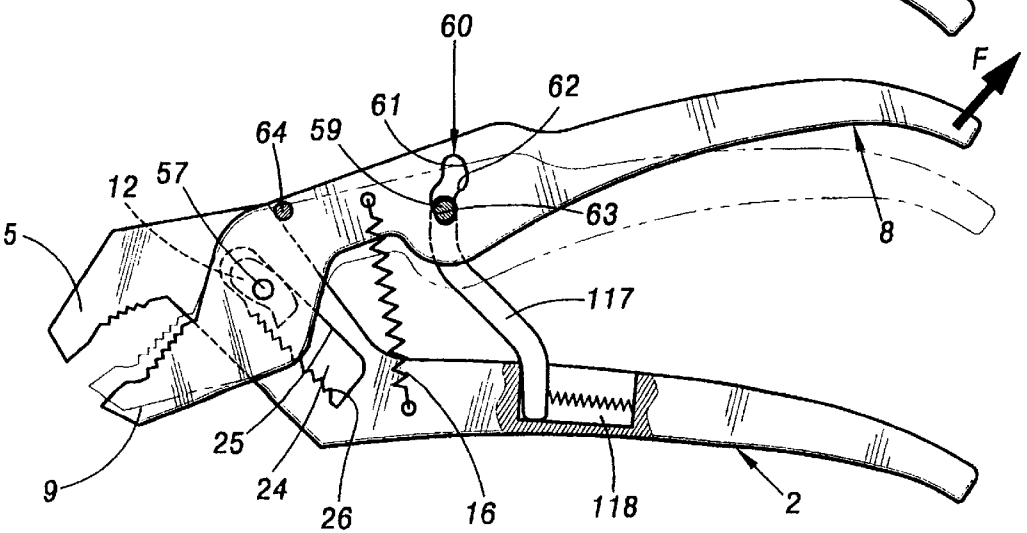
FIG. 11 is a view similar to FIG. 10 illustrating the increase in the separation of the jaws.

It may be noted that the space between the two handles of the pliers is entirely empty, thus reducing the risk that the user will trap his fingers FIGS. 10 and 11 schematically depict a second embodiment of the pliers according to the invention. This alternative form essentially differs from the previous one in terms of the front and rear means of guiding the slipped-through branch 8.

As can be seen, the slots 24 are straight, as in conventional ratchet pliers. In addition, the carriage 11 is omitted, and the finger 12 is simply mounted to rotate freely on a peg 57 secured to the branch 8.

The slider 17 is replaced by an arm 117 which passes through the space just forward of the two handles. The lower end of this arm is pressed by a spring 118 having a relatively high stiffness in the general direction of the branch 2, against a stop 58 secured to this branch. The upper end of the arm 117 bears a transverse stud 59, the ends of which are housed in guide slots 60 in the cheeks 3 and 4. These slots 60 are S-shaped, with an upper region 61 in the form of a circular arc centered on 57, an intermediate oblique shoulder 62, and a downward extension 63, offset forward with respect to the region 61.

Furthermore, the spring 16 that opens the jaws is stretched more or less at a right angle to the overall direction of the two branches, so as to urge the two branches away from each other and tend to move the jaws apart. This spring is oriented carefully with respect to the slots and the branches so as to constantly urge the finger into engagement with the racks 26.

When the finger 12 is in a given position of engagement with the racks 26 (FIG. 10), the dead travel of the stud 59 in the part 61 of the slots 60 allows the tool to be used like conventional pliers. In other words, the arrangement of stud 59 allows the jaws to be opened without changing the position of articulation, and the finger remains in engagement with the racks.

The dead travel is limited by the upper end of the slot 60 and, on the other hand, by the intermediate oblique shoulder 62. It allows repeated gripping of parts without changing the articulation point.

To increase the separation of the jaws, the handles are moved apart until the stud 59 comes into abutment with the shoulder 62, something which the user feels cleanly and the separating of the two handles is continued. The peg 64 then comes into contact with the rear face of the intermediate part of the branch 2 and becomes a center pivot point for the branch 8, which rocks until the set of teeth 49 disengage from the racks 26. At the same time, the stud 59 continues its journey along the lower part 63 of the slot 60. The spring 16, because of its suitable orientation, then opens the jaws to their wide open position.

To decrease the separation of the two jaws, staring from any position of the finger 12, the handles are brought closer together. The arm 117 behaves like an arm articulated via its lower end to the branch 2, so that the stud 59 (in abutment at the top of the slot 60) moves in a roughly circular movement, increasingly compressing the spring 118. Meanwhile, the peg 57 moves forward along the slots 24, ratcheting the finger.

In this embodiment, it is once again possible to adjust the opening of the pliers with one hand. However, when the finger is disengaged as explained above, under the effect of the spring 16 and because of the straight shape of the slots 24, the jaws tend to return instantly to their wide open position.

What is claimed is:

1. An adjustable pair of pliers capable of being operated with one hand, comprising:

a first branch including a jaw portion, a handle portion, and an intermediate articulation portion located between said jaw portion and said handle portion, said articulation portion having an elongated front guide surface and an elongated articulation surface;

a second branch including ajar portion, a handle portion, an intermediate articulation portion located between said jaw portion and said handle portion, and an urging device, said second branch being arranged so as to cross said first branch;

a front guide mechanism supported by said articulation portion of said second branch, and being operable to move along said front guide surface of said first branch;

an articulation mechanism supported by said articulation portion of said second branch and arranged such that said urging device of said second branch urges said articulation mechanism toward said articulation surface of said first branch, whereby said articulation mechanism enrages said articulation surface of said first branch in an absence of a force applied for moving said handle portion of said second branch toward said handle portion of said first branch; and a rear guide mechanism for guiding said second branch, said rear guide mechanism being located between said articulation portion of said second branch and said handle of said second branch, and being operable to urge said articulation mechanism toward a front of said articulation surface of said first branch in response to a force moving said handle of said second branch toward said handle of said first branch.

2. The pliers of claim 1, wherein each of said front guide surface and said articulation surface are arched, said urging device being arranged to urge said articulation mechanism toward an articulation point of said articulation surface, and further comprising an articulation member including said articulation mechanism, said articulation member arranged so as to bear on said second branch at a point longitudinally offset from said articulation point.

3. The pliers of claim 2, wherein said articulation member is arranged so as to bear directly on said first branch and said second branch during a clamping action of said pliers.

4. The pliers of claim 2, wherein said front guide surface and said articulation surface are parallel.

5. The pliers of claim 1, wherein said rear guide mechanism includes an elongated bearing surface on said second branch, and includes a bearing element operable to contact and move along said bearing surface of said second branch, and wherein said rear guide mechanism, said front guide mechanism, said first branch, and said second branch are arranged such that, during a closing phase of said pliers, said front guide mechanism moves along said front guide surface of said first branch and, simultaneously, said bearing element moves along said bearing surface of said second branch.

6. The pliers of claim 5, wherein said bearing surface and said bearing element both remain in a roughly fixed position with respect to said first branch and said second branch during the closing phase of said pliers.

7. The pliers of claim 5, wherein, in any two closing positions of said first branch and said second branch, a first normal at a first point of contact between said front guide surface and said bearing surface at a first closing position forms a V-shaped angle with a second normal at a second point of contact between said front guide surface and said bearing surface at a second closing position, wherein a point of said angle faces toward an opposite side of said first branch and said second branch with respect to said jaw of each of said first branch and said second branch.

8. The pliers of claim 7, wherein said V-shaped angle is less than 90°.

9. The pliers of claim 7, wherein said V-shaped angle is substantially equal to 90°.

10. The pliers of claim 7, wherein said bearing surface on said second branch is arched, a virtual center of curvature of said arched bearing surface being located outside a perimeter of said first branch and said second branch, and located on an opposite side of said bearing surface with respect to a jaw of said first branch and a jaw of said second branch.

11. The pliers of claim 1, wherein at least one of said front guide surface and said articulation surface has a curved cross-sectional profile.

12. The pliers of claim 1, further comprising an opening spring for constantly urging said jaw of said first branch and said jaw of said second branch apart.

13. An adjustable pair of pliers capable of being operated with one hand, comprising:

a first branch including a jaw portion, a handle portion, and an intermediate articulation portion located between said jaw portion and said handle portion, said articulation portion having an elongated front guide surface and an elongated articulation surface, each of said front guide surface and said articulation surface being arched;

a second branch including a jaw portion, a handle portion, and an intermediate articulation portion located between said jaw portion and said handle portion, said second branch being arranged so as to cross said first branch, said second branch having an arched rear bearing surface, a center of curvature of said arched rear bearing surface being located outside a perimeter of said first branch and said second branch and on an opposite side of said rear bearing surface with respect to said jaw of said second branch, said center of curvature of said rear bearing surface being close to a center of curvature of said front guide surface of said first branch in all closing phase positions of said first branch and said second branch;

a front guide mechanism supported by said articulation portion of said second branch, and being operable to move along said front guide surface of said first branch;

an articulation mechanism supported by said articulation portion of said second branch, and operable to be urged toward an articulation point of said articulation surface of said first branch;

a rear guide mechanism for guiding said second branch, said rear guide mechanism being located between said articulation portion of said second branch and said handle of said second branch, and being operable to urge said articulation mechanism toward a front of said articulation surface of said first branch in response to a force moving said handle of said second branch toward said handle of said first branch; and an articulation member including said articulation mechanism, said articulation member arranged so as to bear on said second branch at a point longitudinally offset from said articulation point.

14. An adjustable pair of pliers capable of being operated with one hand, comprising:

a first branch including a jaw portion, a handle portion, and an intermediate articulation portion located between said jaw portion and said handle portion, said articulation portion having an elongated front guide surface and an elongated articulation surface, each of said front guide surface and said articulation surface being arched;

a second branch including a jaw portion, a handle portion, and an intermediate articulation portion located between said jaw portion and said handle portion, said second branch being arranged so as to cross said first branch, said second branch having an arched rear bearing surface, a center of curvature of said arched rear bearing surface being located outside a perimeter of said first branch and said second branch and on an opposite side of said rear bearing surface with respect to said jaw of said second branch, said center of curvature of said rear bearing surface being coincident with a center of curvature of said front guide surface of said first branch in all closing phase positions of said first branch and said second branch;

a front guide mechanism supported by said articulation portion of said second branch, and being operable to move along said front guide surface of said first branch;

an articulation mechanism supported by said articulation portion of said second branch, and operable to be urged toward an articulation point of said articulation surface of said first branch;

a rear guide mechanism for guiding said second branch, said rear guide mechanism being located between said articulation portion of said second branch and said handle of said second branch, and being operable to urge said articulation mechanism toward a front of said articulation surface of said first branch in response to a force moving said handle of said second branch toward said handle of said first branch; and an articulation member including said articulation mechanism, said articulation member arranged so as to bear on said second branch at a point longitudinally offset from said articulation point.

15. An adjustable pair of pliers capable of being operated with one hand, comprising:

a first branch including a jaw portion, a handle portion, and an intermediate articulation portion located between said jaw portion and said handle portion, said articulation portion having an elongated front guide surface and an elongated articulation surface;

a second branch including a jaw portion, a handle portion, and an intermediate articulation portion located between said jaw portion and said handle portion, said second branch being arranged so as to cross said first branch;

a front guide mechanism supported by said articulation portion of said second branch, and being operable to move along said front guide surface of said first branch;

an articulation mechanism supported by said articulation portion of said second branch, and operable to be urged toward an articulation point of said articulation surface of said first branch; and a rear guide mechanism for guiding said second branch, said rear guide mechanism being located between said articulation portion of said second branch and said handle of said second branch, and being operable to urge said articulation mechanism toward a front of said articulation surface of said first branch in response to a force moving said handle of said second branch toward said handle of said first branch, said rear guide mechanism including an elongated bearing surface on said second branch, and including a bearing element operable to contact and move along said bearing surface of said second branch;

wherein said rear guide mechanism, said front guide mechanism, said first branch, and said second branch are arranged such that, during a closing phase of said pliers, said front guide mechanism moves along said front guide surface of said first branch and, simultaneously, said bearing element moves along said bearing surface of said second branch; and wherein said rear guide mechanism, said articulation mechanism, said first branch, and said second branch are arranged such that, during an opening phase of said pliers, said bearing surface moves away from said bearing element to open said pliers at each position of said articulation mechanism with respect to said articulation surface of said first branch.

16. An adjustable pair of pliers capable of being operated with one hand, comprising:

a first branch including a jaw portion, a handle portion, and an intermediate articulation portion located between said jaw portion and said handle portion, said articulation portion having an elongated front guide surface and an elongated articulation surface, said articulation surface having teeth;

a second branch including a jaw portion, a handle portion, and an intermediate articulation portion located between said jaw portion and said handle portion, said second branch being arranged so as to cross said first branch;

a front guide mechanism supported by said articulation portion of said second branch, and being operable to move along said front guide surface of said first branch;

an articulation mechanism supported by said articulation portion of said second branch, and operable to be urged toward an articulation point of said articulation surface of said first branch, said articulation mechanism having teeth; and a rear guide mechanism for guiding said second branch, said rear guide mechanism being located between said articulation portion of said second branch and said handle of said second branch, and being operable to urge said articulation mechanism toward a front of said articulation surface of said first branch in response to a force moving said handle of said second branch toward said handle of said first branch, said rear guide mechanism including:

an elongated bearing surface on said second branch;

a bearing element operable to contact and move along said bearing surface of said second branch; and a spring for urging said bearing element toward said bearing surface and toward a predetermined stop position;

wherein said rear guide mechanism, said front guide mechanism, said first branch, and said second branch are arranged such that, during a closing phase of said pliers, said front guide mechanism moves along said front guide surface of said first branch and, simultaneously, said bearing element moves along said bearing surface of said second branch.

17. An adjustable pair of pliers capable of being operated with one hand, comprising:

a first branch including a jaw portion, a handle portion, and an intermediate articulation portion located between said jaw portion and said handle portion, said articulation portion having an elongated front guide surface and an elongated articulation surface;

a second branch including a jaw portion, a handle portion, and an intermediate articulation portion located between said jaw portion and said handle portion, said second branch being arranged so as to cross said first branch;

a front guide mechanism supported by said articulation portion of said second branch, and being operable to move along said front guide surface of said first branch;

an articulation mechanism supported by said articulation portion of said second branch, and operable to be urged toward an articulation point of said articulation surface of said first branch; and a rear guide mechanism for guiding said second branch, said rear guide mechanism being located between said articulation portion of said second branch and said handle of said second branch, and being operable to urge said articulation mechanism toward a front of said articulation surface of said first branch in response to a force moving said handle of said second branch toward said handle of said first branch, said rear guide mechanism including a dead-travel connection operable to allow said jaw of said first branch and said jaw of said second branch to open with respect to each other a predetermined amount in each position of said articulation mechanism along said articulation surface.

18. The pliers of claim 17, wherein one of said first branch and said second branch includes a stop for moving said articulation mechanism away from said articulation surface when said jaw of said first branch and said jaw of said second branch are opened beyond said predetermined amount.

19. The pliers of claim 17, wherein said rear guide mechanism further includes an arm having a first end and a second end, said dead-travel connection being located between said first end of said arm and said second branch, said second end of said arm being operable to move along said first branch and being elastically urged toward a stop of said first branch.

20. An adjustable pair of pliers capable of being operated with one hand, comprising:

a first branch including a jaw portion, a handle portion, and an intermediate articulation portion located between said jaw portion and said handle portion, said articulation portion having an elongated front guide surface and an elongated articulation surface;

a second branch including a jaw portion, a handle portion, and an intermediate articulation portion located between said jaw portion and said handle portion, said second branch being arranged so as to cross said first branch;

a front guide mechanism supported by said articulation portion of said second branch, and being operable to move along said front guide surface of said first branch;

an articulation mechanism supported by said articulation portion of said second branch, and operable to be urged toward an articulation point of said articulation surface of said first branch;

a rear guide mechanism for guiding said second branch, said rear guide mechanism being located between said articulation portion of said second branch and said handle of said second branch, and being operable to urge said articulation mechanism toward a front of said articulation surface of said first branch in response to a force moving said handle of said second branch toward said handle of said first branch; and a helical opening spring for constantly urging said jaw of said first branch and said jaw of said second branch apart, said opening spring being arranged so as to be flexed by a bearing surface of said second branch during a clamping action of said pliers.

21. An adjustable pair of pliers capable of being operated with one hand, comprising:

a first branch including a jaw portion, a handle portion, and an intermediate articulation portion located between said jaw portion and said handle portion, said articulation portion having an elongated front guide surface and an elongated articulation surface;

a second branch including a jaw portion, a handle portion, and an intermediate articulation portion located between said jaw portion and said handle portion, said second branch being arranged so as to cross said first branch;

a front guide mechanism supported by said articulation portion of said second branch, and being operable to move along said front guide surface of said first branch, said guide mechanism comprising a U-shaped carriage, a circular open recess extending through said U-shaped carriage and said second branch so as to form a bearing;

an articulation mechanism supported by said articulation portion of said second branch, and operable to be urged toward an articulation point of said articulation surface of said first branch, said articulation mechanism comprising a finger having an end bulge fitted in said bearing; and a rear guide mechanism for guiding said second branch, said rear guide mechanism being located between said articulation portion of said second branch and said handle of said second branch, and being operable to urge said articulation mechanism toward a front of said articulation surface of said first branch in response to a force moving said handle of said second branch toward said handle of said first branch.

* * * * *